US010267610B2

(12) United States Patent
Pacheco

(10) Patent No.: US 10,267,610 B2
(45) Date of Patent: Apr. 23, 2019

(54) LOCKING SYSTEM FOR AN AMMUNITION CAN

(71) Applicant: Luis Pacheco, Graham, WA (US)

(72) Inventor: Luis Pacheco, Graham, WA (US)

( * ) Notice: Subject to any disclaimer, the term of this patent is extended or adjusted under 35 U.S.C. 154(b) by 261 days.

(21) Appl. No.: 15/209,474

(22) Filed: Jul. 13, 2016

(65) Prior Publication Data

US 2018/0017367 A1 Jan. 18, 2018

(51) Int. Cl.
*F42B 39/22* (2006.01)
*E05B 65/00* (2006.01)
*E05B 67/38* (2006.01)

(52) U.S. Cl.
CPC ..... *F42B 39/22* (2013.01); *E05B 65/006* (2013.01); *E05B 67/383* (2013.01)

(58) Field of Classification Search
CPC ..... F42B 39/22; E05B 65/006; E05B 67/383; E05B 65/48
USPC ..... 70/2–13, 63, 158, 229, 230
See application file for complete search history.

(56) References Cited

U.S. PATENT DOCUMENTS 1,570,449 A * 1/1926 Pittelkow ..... E05C 19/08 292/285
2,705,575 A * 4/1955 Hammer ..... F42B 39/00 206/3
2,872,066 A * 2/1959 Piker ..... E05B 65/52 220/324
4,031,722 A * 6/1977 Michelman ..... E05B 65/0089 292/258
4,751,833 A * 6/1988 Stumpf, Jr. ..... B62D 43/007 224/42.24
6,082,601 A * 7/2000 Standish ..... B60R 7/14 206/317
6,193,449 B1 * 2/2001 Diaz ..... B23B 47/287 408/115 R
6,948,343 B2 * 9/2005 Williamson ..... E05B 65/48 70/158
2002/0030025 A1 * 3/2002 Sipe ..... A47B 81/00 211/4
2006/0162403 A1 * 7/2006 Handel ..... A45C 13/1084 70/63
2009/0044736 A1 * 2/2009 Huber ..... E05G 1/005 109/51
2009/0303666 A1 * 12/2009 Brizes ..... H02B 1/46 361/658

FOREIGN PATENT DOCUMENTS

GB 191503920 A * 3/1916 ..... E05B 65/52
GB 182381 A * 7/1922 ..... E05B 65/52
GB 356303 A * 9/1931 ..... G11B 3/54
GB 2105399 A * 3/1983 ..... B60P 3/03
GB 2320517 A * 6/1998 ..... E05B 73/0082

* cited by examiner

*Primary Examiner* — Suzanne L Barrett
(74) *Attorney, Agent, or Firm* — Mohr Intellectual Property Law Solutions, PC

(57) ABSTRACT

Locking systems for ammunition cans, including locking systems configured to removably attach to the ammunition can front side. In some examples, the locking system includes a latch frame, a front plate, and a cover panel. In some further examples, the front plate is parallelly affixed to the latch frame. In other examples, the latch frame is removably fitted over a plate. Finally, in even further examples, the locking system may be secured with a device such as a padlock or a combination lock.

17 Claims, 8 Drawing Sheets

LOCKING SYSTEM FOR AN AMMUNITION CAN

BACKGROUND

The present disclosure relates generally to locking systems. In particular, locking systems for use with ammunition cans are described.

Known ammunition can locking systems are not entirely satisfactory for the range of applications in which they are employed. For example, existing locking systems require significant after-market modifications and retrofitting in order for them to function properly. In addition, conventional ammunition can locking systems are easily tampered with and can become disengaged with minimal effort. This results in the contents of the cans being accessed by unintended individuals.

Thus, there exists a need for ammunition can locking systems that improve upon and advance the design of known ammunition can locking systems. Examples of new and useful ammunition can locking systems relevant to the needs existing in the field are discussed below.

SUMMARY

Locking systems for ammunition cans, including locking systems configured to removably attach to the ammunition can front side are shown and described. In some examples, the locking system includes a latch frame, a front plate, and a cover panel. In other examples, the latch frame is removably fitted over a plate. Finally, in even further examples, the locking system may be secured with a device such as a padlock or a combination lock

BRIEF DESCRIPTION OF THE DRAWINGS

FIG. 4B FIG. 4A is a perspective view of the ammunition can locking system shown in FIG. 1 depicting a view of the inward facing surface of a securing plate.

DETAILED DESCRIPTION

Figure 1:
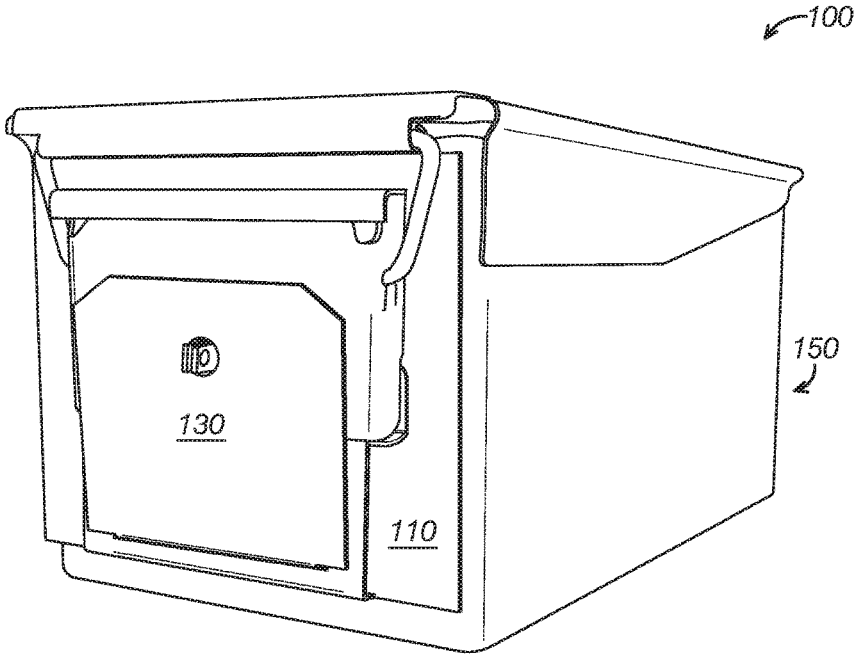
FIG. 1 is a perspective vim of a first example of an ammunition can locking system.

Cans for storing ammunition are well known in the art and readily available from military surplus suppliers and specialty retailers. They typically comprise a rectangular canister of metal or plastic with a hinged lid. Most models have a clamp-lever type of latching mechanism for keeping the lid closed. Most common ammunition cans do not come equipped with a locking mechanism, thus requiring the purchaser to figure out the best way to prevent unauthorized or unintended access to the contents of the can.

As concerns regarding firearms and firearm safety continue to escalate, the need for a safe and reliable means for retaining ammunition and other items in secured containers such as those mentioned above remains high. The disclosed locking systems will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation not individually described in the following detailed description.

Throughout the following detailed description, examples of various locking systems are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

With reference to FIGS. 1-11, a first example of an ammunition can locking system, locking system 100, will now be described. Locking system 100 functions to secure the contents of a standard ammunition can. It is an object of the present invention to work with the existing components of a standard ammunition can regardless of the contents of the can. Locking system 100 addresses many of the shortcomings existing with conventional ammunition can locks. For example, it does not require after-market modifications or retrofitting in order accomplish its stated purpose. In addition, once installed, it is not easily tampered with and does not have a great potential for accidental or unintended disengagement.

Thus, from the following figures and descriptions, the reader will appreciate that the present invention is an improved system for securing the contents of an ammunition can. It is easy to use, durable, cheap to manufacture, and can work with a variety of different types of ammunition cans that the user may employ. Standard ammunition cans are typically rectangular boxes with a hinged lid having a clamp lever fastening means. It is an object of the present invention to function with the clamp lever fastening means of any standard ammunition can. In the present embodiment, and by way of example, ammunition can 150 comprises a steel military standard 50 Cal ammunition can. It should be understood that it is an object of the present invention to work with any ammunition can with a latching mechanism, regardless of tare material, size, or capacity. Thus, the use will appreciate that locking system 100 may be used to secure other types of boxes, such as mortar cans and the like. In order to use locking system 100, the user will attach a component of the system to the front of an ammunition can 150 and secure the lid shut with a second component. The user is then free to select the appropriate locking mechanism according to his or her preference.

As shown in FIG. 1, locking system 100 includes a frame 110 and a plate 130 that work with the front panel, latch, and lid of ammunition can 150 in order to secure it in the closed position. Finally, in the present embodiment, each component of locking system 100 is made of steel, however, it is contemplated within the current invention that other metals and metal alloys, polymers, and other suitable materials may be used.

Figure 2A:
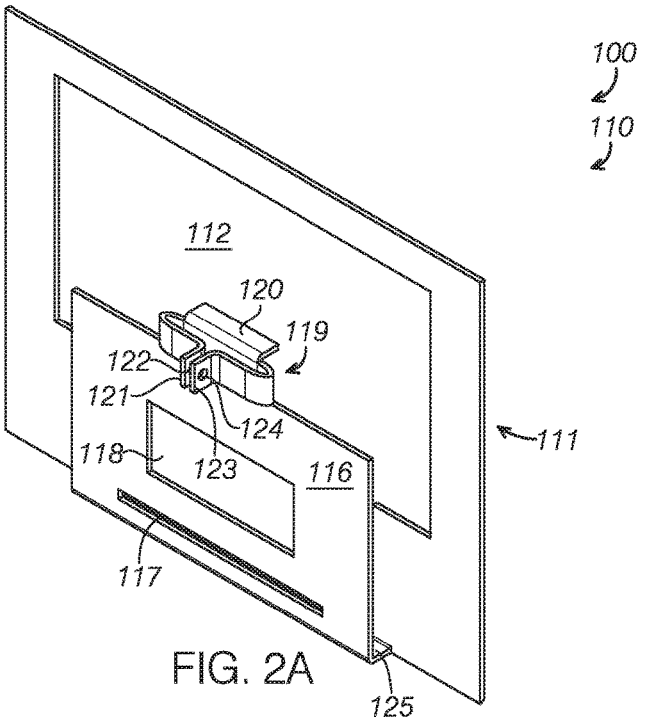
FIG. 2A is a perspective view of the ammunition can locking system shown in FIG. 1 depicting a view of the inward facing surface of a framing mechanism.
Figure 2B:
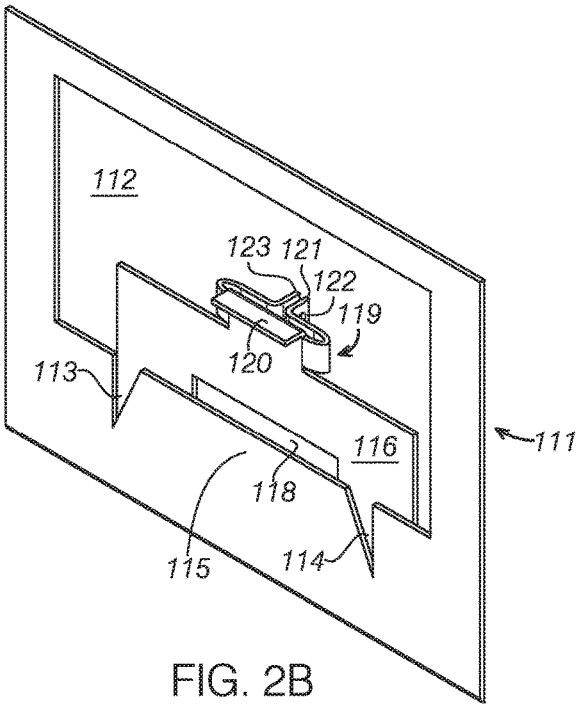
FIG. 2B is a perspective view of the ammunition can locking system shown in FIG. 1 depicting a view of the outward acing surface of a framing mechanism.

With reference to FIGS. 2A and 2B, a perspective view of frame 110 according to an embodiment of locking system 100 shown in FIG. 1 is shown. FIG. 2A depicts a view of the outward facing surface of frame 110, while FIG. 2B depicts a view of the inward facing surface of frame 110. Thus, when in use, the inward facing surface of frame 110 remains in flush contact with the front of an ammunition can while the outward facing surface protrudes away from the front of the can. As can be seen, frame 110 comprises a boundary 111 having a window 112 with a first slot 113, a second slot 114 and a strip 115.

In the present embodiment, frame 110 encloses panel 116 and further comprises a panel 116 having a slot 117, an opening 118, and a support 119. Support 119 further comprises an overhang 120, a first tab 121 having a first tab aperture 122, a second tab 123 having a second tab aperture 124, and a channel 125. In the present embodiment, frame 110 is rectangular by way of example only. It should be understood that the present invention contemplates other geometric shapes that may be used as required by the user's needs and the specific ammunition can locking system 100 is securing.

Figure 3:
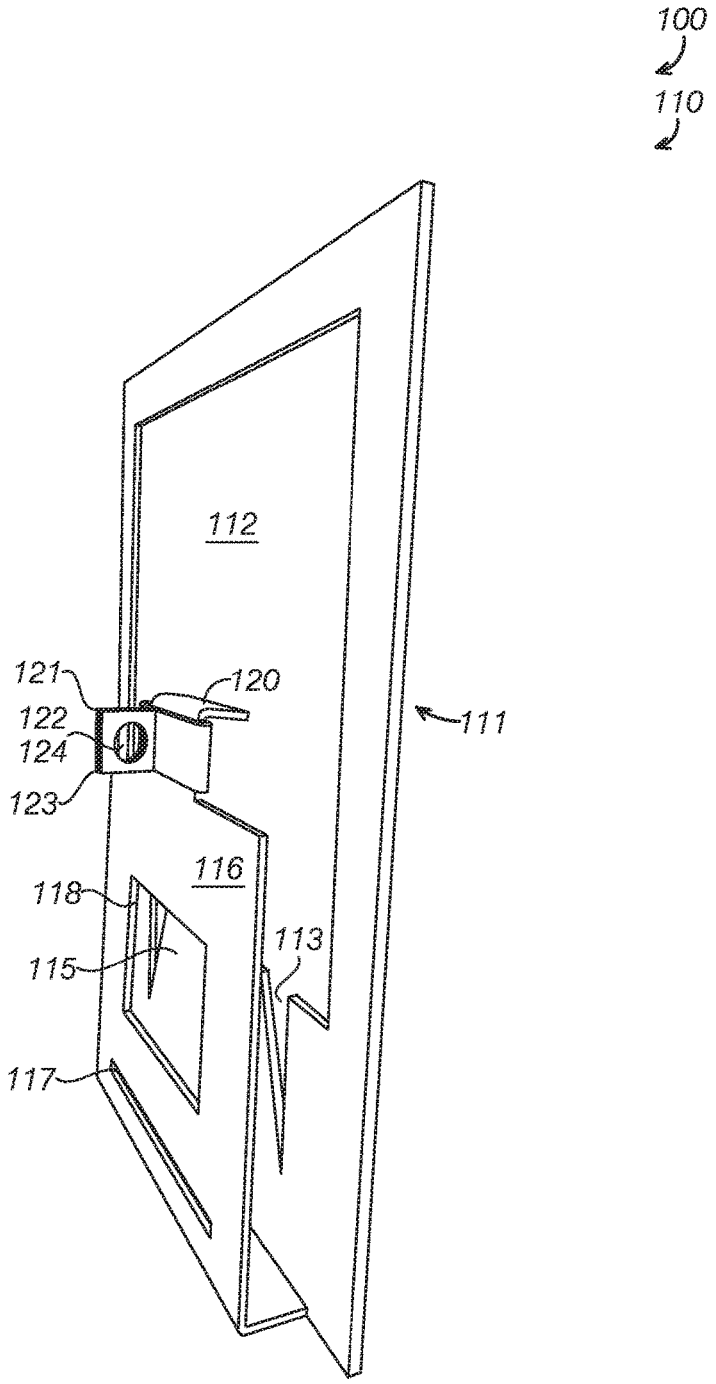
FIG. 3 is a side view of the surface framing mechanism according to an embodiment of the ammunition can locking system shown in FIG. 1

FIG. 3, then, is a side view of frame 110. In this embodiment, the dimensions of first aperture 122 and second aperture 124 are substantially identical and positioned on first tab and second tab (122, 124) such that they align to form a single hole as shown.

Figure 4A:
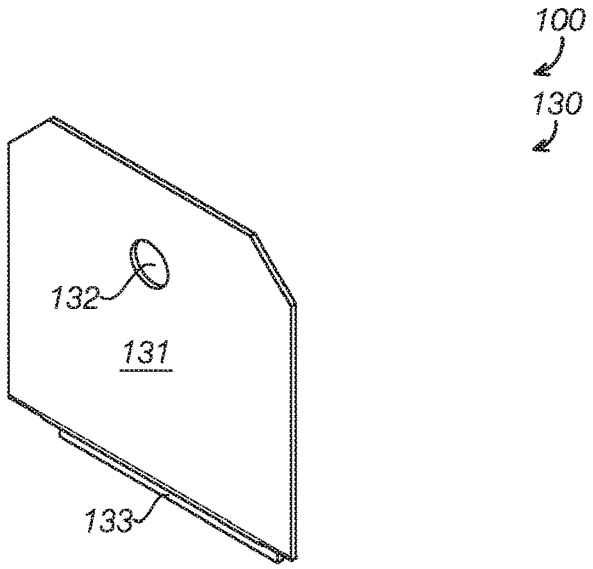
FIG. 4A is a perspective view of the ammunition can locking system shown in FIG. 1 depicting a view of the outward facing surface of a securing plate.
Figure 4B:
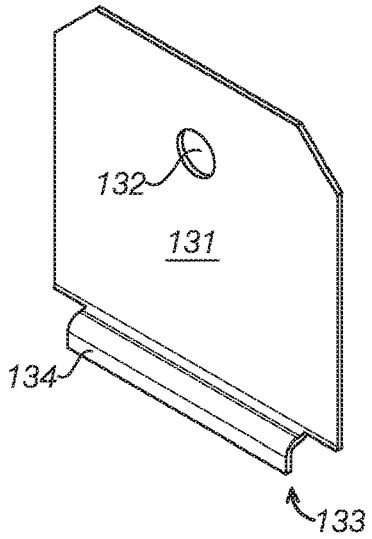

With reference to FIGS. 4A and 4B, a perspective view of plate 130 according to an embodiment of locking system 100 shown in FIG. 1 is shown. FIG. 4A depicts a view of the outward facing surface of plate 130, while FIG. 4B depicts a view of the inward facing surface of plate 130. As can be seen, plate 130 comprises a panel 131 having a panel aperture 132. As shown in FIG. 4B, plate 130 further comprises a leaf 133 having a tongue 134. It should be understood that the dimensions of plate 130 are complimentary to the dimensions of frame 110 and ammunition can 150. Thus, panel aperture 132 is configured to removably receive first tab 121 and second tab 123 and fit snugly over panel 116 (discussed in farther detail below).

Figure 5:
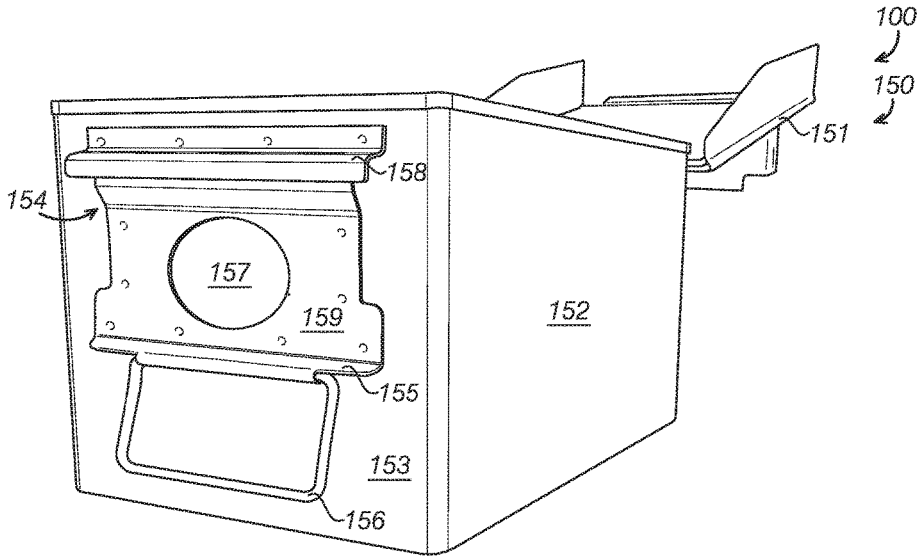
FIG. 5 is a perspective view of an open ammunition can.

As mentioned above, locking system 100 is designed to secure the contents of an ammunition can. Thus, with reference to the remaining figures, locking system 100 works in conjunction with the existing components of a standard ammunition can without the need for retrofitting or modification to the can itself. Turning attention to FIG. 5, then, an example of a typical ammunition can is shown and described. As can be seen, ammunition can 150 is a substantially rectangular container having a lid 151 (shown in further detail and described in FIG. 7), a right side 152 and a left side (not shown). Ammunition can 150 further comprises a bottom and a back (not shown) and a front side 153. In the present embodiment, front side 153 includes a lid securing mechanism 154 having a lip 155, a loop 156, a center hole 157, an overhang 158, and a latch support 159.

Figure 6:
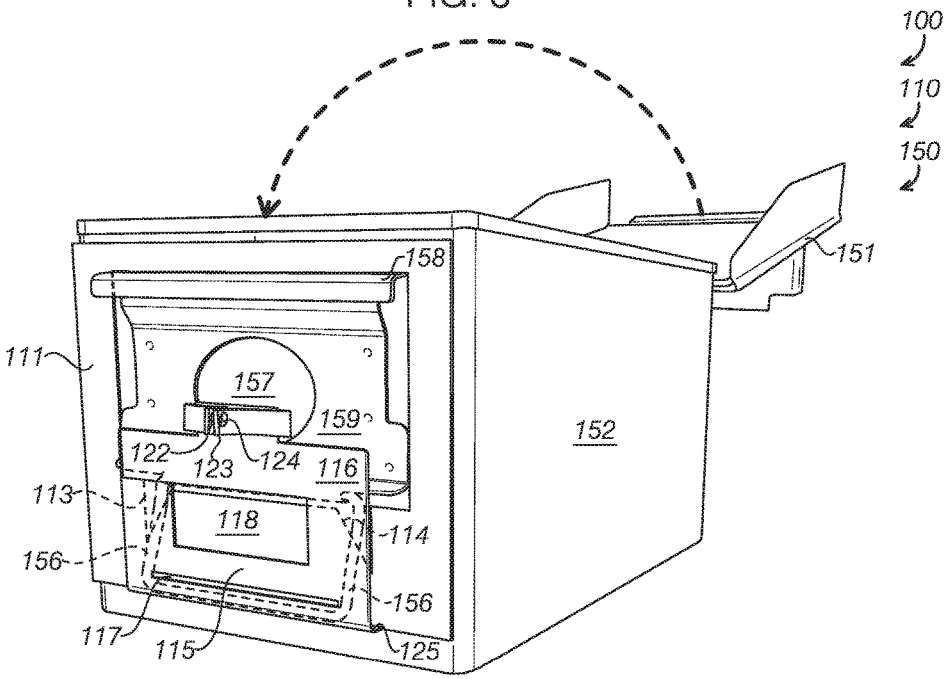
FIG. 6 is a perspective view of a framing mechanism positioned on the front of an open ammunition can according to an embodiment of the present invention.

Referring to FIGS. 6-11, when the user wishes to secure the contents of ammunition can 150, he or she may employ locking system 100 in the following manner. With lid 151 in the open position as shown in FIGS. 5 and 6, the user will deposit items to be secured within ammunition can 150 and attach frame 110 by positioning it over the can front 153 as shown. The user may then align one side of loop 156 first slot 113 and the other side of loop 156 in second slot 114 such that strip 115 remains between the two as shown. In this manner, frame 110 functions to removably retain loop 156 within channel 125 as shown. The user will then snap frame 110 into place via friction over the can front side 153. In this manner, when affixed to front side 153, loop 156 rests within channel 125. Similarly, when frame 110 is in this position, the top portion of boundary 111 rests above over overhang, support 119 and overhang 120 rest flush against and within center hole 157 as shown. In this manner, frame 110 functions to act as the base for locking system 100.

Figure 7:
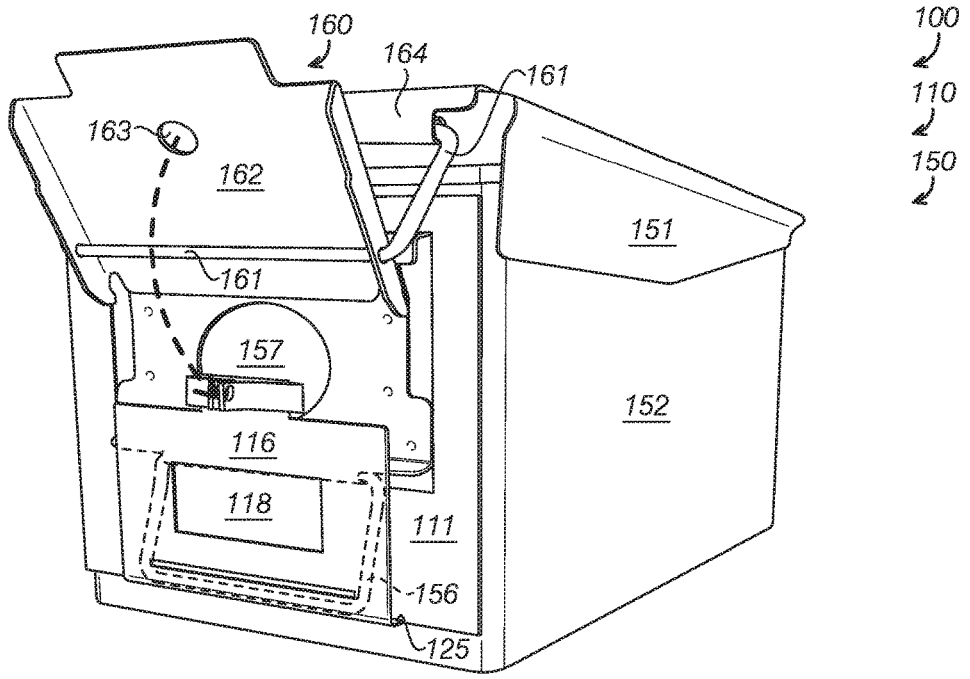
FIG. 7 is a perspective view of a framing mechanism positioned on the front of a closed ammunition can according to an embodiment of the present invention
Figure 8:
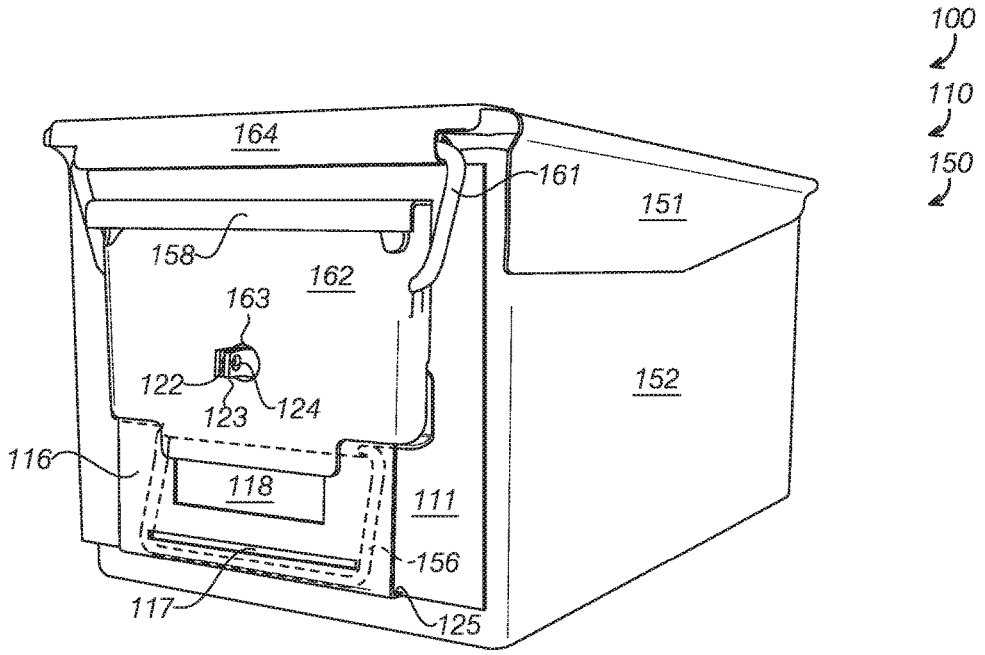
FIG. 8 is a perspective view of a framing mechanism secured to the front of a closed ammunition according to an embodiment of the present invention.

Referring now to FIGS. 7 and 8, a view of ammunition can 150 where lid 151 is in the closed position is shown. After the user has positioned frame 110 in place as shown and described in FIG. 6, the user will then secure lid 151 over frame 110. In the present example, lid 151 comprises a top latch 160 having a ring 161 within a ring holder 164, and a latch plate 162 having a latch plate aperture 163. As can be seen, ring 161 is inserted through ring holder 164 and latch plate 162 as shown. In this manner, latch plate 162 pivotally moves up and down such that it may cover frame 110. Thus, after the user has attached frame 110 in the manner described above, he or she will lower latch plate 162 over frame 110 such that latch plate aperture 163 fits over first tab 121 and second tab 123 as shown in FIG. 8. It should be understood that the dimensions and location of plate aperture 163 are complimentary to first tab 121 and second tab 123 such that it removably receives first tab 121 and second tab 123 when latch plate 162 is lowered (as shown in FIG. 8).

Figure 9:
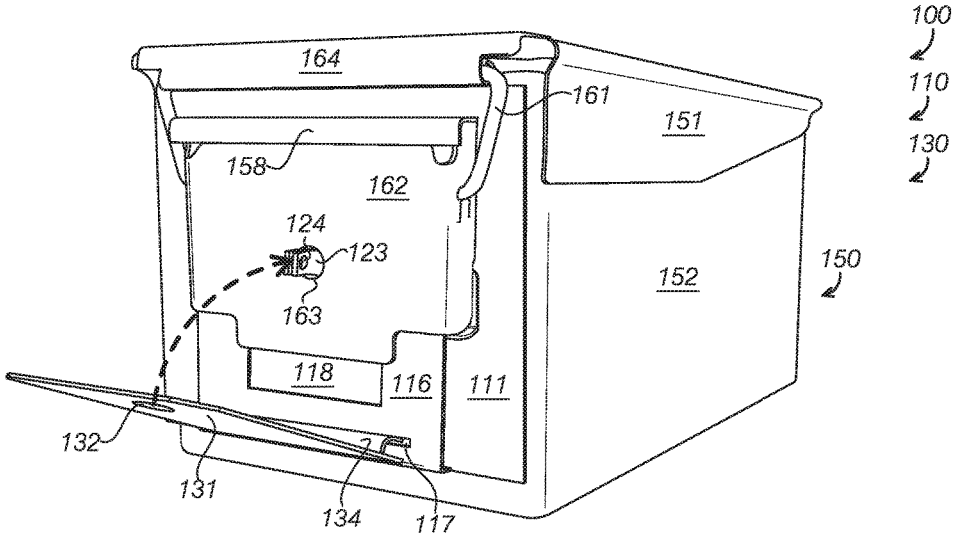
FIG. 9 is a perspective view of a securing plate inserted into the front of a closed ammunition can.
Figure 10:
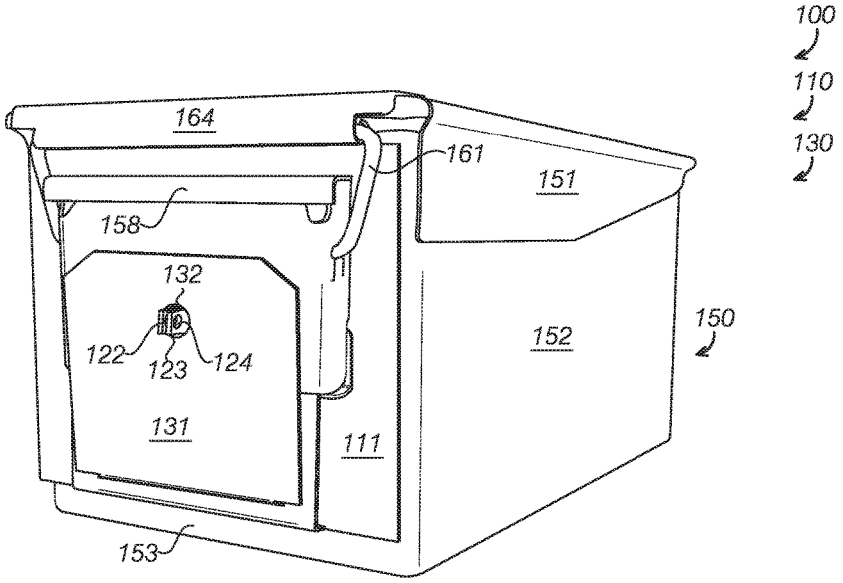
FIG. 10 is a perspective view of a securing plate secured to the front of a closed ammunition according to an embodiment of the present invention

With reference now to FIGS. 9 and 10, a view of plate 131 in use with ammunition can 150 and frame 110 is shown. After the user has positioned frame 110 and secured lid 151 in the closed position as described above, the user will then attach plate 131 over frame 110. The user will align leaf 133 with slot 117. In the present embodiment, the dimensions of leaf 133 and tongue 134 are complimentary to slot 117 as shown. In this manner, the user is able to removably insert leaf 133 into slot 117 and pivot plate 110 upward such that tongue 134 rests against the inside of plate 110 as shown in FIG. 9. Similar to the aperture mentioned above, the dimensions and location of panel aperture 132 are complimentary to the dimensions of plate a 63, first tab 121, and second tab 123 such that it removably receives first tab 121 and second tab 123 when plate 131 is pivoted upward (as shown in FIG. 9). Thus, when panel 130 is pivoted upward, panel aperture 132 removably receives first tab 121 and second tab 123 and remains in position via friction fit as shown. In this manner, plate 130 prevents lid 151 from becoming unlatched by securing latch plate 162 in place over can front 153 as shown. Thus, as can be seen in the present and preceding figures, the components of locking system 100 work with, and around, the components of an ammunition can to secure the latching mechanism and lid in a closed position.

Figure 11:
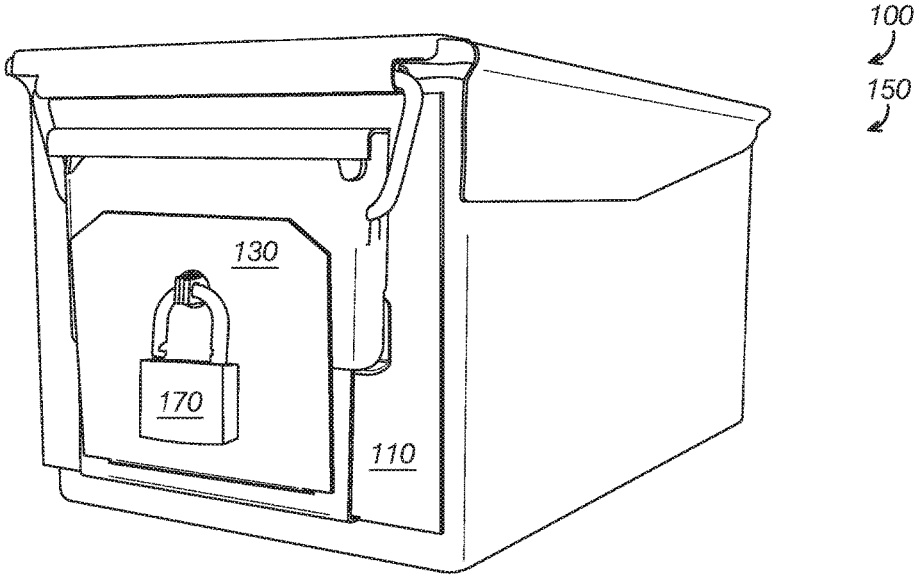
FIG. 11 is a perspective view of the ammunition can securing system in use according to an embodiment of the present invention.

Referring finally to FIG. 11, an alternative embodiment of locking system 100 is shown. In this embodiment, the user may wish to employ a securing means 170 in connection with locking system 100. In order to secure locking system 100 to ammunition can 150 with a security measure such as a lock, the user may thread the security measure through first tab aperture 122 and second tab aperture 122 as shown. In this manner, locking system 100 prevents lid 151 from being opened accidentally or by unintended persons and the contents of ammunition box 150 are kept safe. In the present embodiment, securing means 170 is a keyed padlock, whereby the shank of the padlock is threaded through first tab aperture 122 and second tab aperture 122 as shown. However it should be understood that securing means 170 may any item sufficient to secure locking system 100 in place, including but not limited to, keyed and combination locks, cable locks, knotted cords, zip or twist ties, and other suitable means according to the user's preference.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A device, comprising:

an ammunition can comprising a left side, a right side, a bottom side, a front side a rear side, and a lid, wherein the lid comprises:

a lid flange connected to an edge of the lid;

a first polygonal loop having a first end connected to an edge of the lid flange; and a securing plate connected to a second end of the first polygonal loop, the securing plate including a securing plate aperture;

a latch frame connected to the front side of the ammunition can, the latch frame comprising;

a latch plate affixed to the latch frame by a support member and a second polygonal loop, the latch plate including a top flange, a center aperture, and a bottom flange having the second polygonal loop;

a plate bar attached to an outer surface of the latch plate; and a tab extending from the plate bar; and a cover panel attached to the latch frame, the cover panel having a lip, a cover panel aperture, and a bottom flange configured to connect to the second polygonal loop, the cover panel aperture and the securing plate aperture configured to receive the tab, wherein the tab is configured to receive a securing device to secure the securing plate and the cover panel to the latch plate.

2. The device of claim 1, wherein the latch plate is affixed to the latch frame in parallel via the support member.

3. The device of claim 1, wherein the latch frame is removably connected to the front side of the ammunition can.

4. The device of claim 1, wherein the latch plate bar is extends outwardly in front of the latch plate.

5. The device of claim 1, wherein the cover panel aperture removably receives the tab.

6. The device of claim 1, wherein the cover panel removably attached to the latch plate.

7. The device of claim 1, wherein the cover panel is configured to pivot about the second polygonal loop to cover the latch plate.

8. The device of claim 1, wherein the securing device is a lock removably inserted through the tab.

9. A device, comprising:

an ammunition can comprising a left side, a right side, a bottom, a front side, a rear side, and a lid, wherein the lid comprises:

a lid flange connected to an edge of the lid;

a first polygonal loop having a first end connected to an edge of the lid flange; and a securing plate connected to a second end of the first polygonal loop, the securing plate including a securing plate aperture;

a latch frame connected to the front side of the ammunition can, the latch frame comprising:

a latch plate affixed to the latch frame by a support member and a second polygonal loop, the latch plate including a top flange, a center aperture, and a bottom flange having the second polygonal loop;

a plate bar attached to an outer surface of the latch plate; and a tab extending from the plate bar;

a cover panel attached to the latch frame, the cover panel having a lip a cover panel aperture, and a bottom flange configured to connect to the second polygonal loop, the cover panel aperture and the securing plate aperture configured to receive the tab; and a securing device configured to secure to secure the securing plate and the cover panel to the latch plate.

10. The device of claim 9, wherein the plate bar extends outwardly in front of the latch plate.

11. The device of claim 9, wherein the tab further comprises a hole to receive the securing device.

12. The device of claim 9, wherein the latch plate comprises a slot configured to removably receive a lip of the cover panel.

13. The device of claim 9, wherein the cover panel is configured to cover the latch plate.

14. The device of claim 9, wherein the cover panel aperture removably receives the tab.

15. The device of claim 14, wherein the securing device is removably inserted through the tab.

16. A method, comprising:

placing items in an ammunition box having a lid comprising a latch having a latch aperture;

positioning a latch frame having a front plate and a tab comprising a hole in front of the ammunition box;

snapping the latch frame into place on the front of the ammunition box;

closing the lid;

latching the lid over the latch frame;

inserting the tab into the latch aperture;

inserting a plate having a plate aperture into the latch frame;

pivoting the plate up and over the front of the latch;

aligning the plate aperture with the latch aperture and the tab; and inserting a locking mechanism through the hole.

17. The method of claim 16, further comprising:

removing the locking mechanism from the hole;

pivoting the plate down and in front the front of the latch;

removing the plate from the latch frame;

unlatching the lid;

opening the lid;

removing the latch frame from the front of the ammunition box; and removing contents of the ammunition box.

* * * * *